US008593064B2

(12) United States Patent
Chang Diaz

(10) Patent No.: US 8,593,064 B2
(45) Date of Patent: Nov. 26, 2013

(54) PLASMA SOURCE IMPROVED WITH AN RF COUPLING SYSTEM

(75) Inventor: Franklin Chang Diaz, Seabrook, TX (US)

(73) Assignee: AD Astra Rocket Company, Webster, TX (US)

( * ) Notice: Subject to any disclaimer, the term of this patent is extended or adjusted under 35 U.S.C. 154(b) by 1059 days.

(21) Appl. No.: 12/449,612

(22) PCT Filed: Feb. 19, 2008

(86) PCT No.: PCT/US2008/002381

§ 371 (c)(1),
(2), (4) Date: Aug. 17, 2009

(87) PCT Pub. No.: WO2008/100642

PCT Pub. Date: Aug. 21, 2008

(65) Prior Publication Data

US 2010/0213851 A1 Aug. 26, 2010

(51) Int. Cl.
*H01J 7/24* (2006.01)

(52) U.S. Cl.
USPC ..... 315/111.61; 315/111.71

(58) Field of Classification Search
USPC ..... 315/111.21, 111.41, 111.61, 111.71, 315/111.81; 60/202, 203.1
See application file for complete search history.

(56) References Cited

U.S. PATENT DOCUMENTS 5,430,355 A * 7/1995 Paranjpe ..... 315/111.21
6,293,090 B1 * 9/2001 Olson ..... 60/203.1
6,812,647 B2 * 11/2004 Cornelius ..... 315/111.41
7,420,182 B2 * 9/2008 Hruby et al. ..... 250/427

* cited by examiner

*Primary Examiner* — Thuy Vinh Tran
(74) *Attorney, Agent, or Firm* — Law Office of Art Duli; Scott L. Maddox; Arthur M. Dula

(57) ABSTRACT

A plasma source comprising an RF coupling system, magnets or coils that generate magnetic fields, a gas injection system, and a vacuum tight, RF transparent gas containment tube, wherein the RF coupling system comprises an RF coupler and the plasma source further comprises a choke point wherein the ratio of the field strength at said choke point to the field strength at said RF coupler is greater than two.

21 Claims, 13 Drawing Sheets

PLASMA SOURCE IMPROVED WITH AN RF COUPLING SYSTEM

BACKGROUND

1. Field of the Invention

This invention pertains generally to plasma sources that ionize gas and heat plasma using RF antennas, applied magnetic fields, plasmas and coaxial gas confinement tubes. Applications comprise plasma production for doping and testing materials in plasma processing applications, breakdown of toxic gas streams, and sterilization of materials by bombardment with plasma. Space applications comprise using these systems for rocket engines to provide thrust by discharging ionized particles in a particular direction. More specifically, the invention relates to improvements to antennas, magnet geometries, and thermal solutions for the steady state production and heating of plasmas.

2. Description of the Related Art

The application that covers the broadest implementation of these arts is the Variable Specific Impulse Rocket (VASIMR). The VASIMR is fundamentally an electromagnetic plasma accelerator that borrows heavily from the physics and technology of magnetic confinement fusion research. In the jargon of the fusion community it is called a "magnetic mirror," an open magnetic system or "linear machine" because unlike the toroidal Stellerator or Tokamak, the topology of the magnetic field is open. Linear machines were pursued heavily in the 1970s as potential fusion devices, but due to their weak axial plasma confinement, lost favor in the United States over closed topology magnetic systems such as the Tokamak and the Stellerator. The weakness of the mirror machine as a plasma confinement device is the strength of the VASIMR as a plasma thruster. Plasma in these systems is radially confined, but free to flow axially out of the device to provide rocket propulsion. Therefore, the bulk of the prior art on open ended magnetic confinement systems could be relevant to furthering the technology of the VASIMR.

Three linked magnetic stages perform specific interrelated functions in VASIMR. The first stage handles the main injection of propellant gas and its ionization; the second, also called the "RF booster" acts to further energize the plasma; the third stage is a magnetic nozzle, which converts the energy of the fluid into directed flow. VASIMR is a radio frequency (RF) driven device where the ionization of the propellant is done by a helicon-type discharge. The plasma ions are further accelerated in the second stage by ion cyclotron resonance heating (ICRH), a well-known technique, used extensively in magnetic confinement fusion research.

It is known in the art that plasma may be accelerated by a series of antennas to generate thrust in a rocket engine. U.S. Pat. No. 6,334,302 describes a variable specific impulse magnetoplasma rocket (VASIMR) using two antennas to deliver energy to a gas stream. First, a helicon antenna is used as part of a helicon plasma generator to impart radio frequency (RF) power to the gas stream exciting the gas atoms to an ionized state.

Downstream of the helicon antenna, the resulting plasma is subjected to additional RF power imparted by an Ion Cyclotron Radio Heating (ICRH) antenna to excite ion cyclotron resonance on the plasma. The power imparted to the plasma by the antennas is converted to kinetic energy when the ions are thereafter ejected through a magnetic nozzle to provide the desired thrust.

Overall system efficiency, neglecting any ambipolar contribution to thrust, can be expressed as a ratio of exhaust kinetic energy to electrical power input, where part of the electrical power input goes to the helicon plasma generator and part goes to ICRH antenna. Lower mass flow has higher flow velocity, demonstrating variable specific impulse control technique.

In a VASIMR rocket, neutral gas is first injected into a tube with RF compatible dielectric properties. As the gas flows downstream, plasma is generated as the gas is ionized by a helicon antenna. At this stage the temperature of the plasma may be about 60,000 Kelvin. As the plasma flows further downstream it is further heated by an ion cyclotron resonance heating (ICRH) antenna where it could reach temperatures in the millions of Kelvin. The engine's surrounding surfaces are protected from direct contact high temperature plasma by a magnetic field acting on the plasma. However, considerable heat is still transferred between the hot plasma and the antennas, primarily 15 through radiation from the plasma.

A heat pipe is a passive device for heat removal. The extremely high temperatures associated with the plasma require that the plasma be contained by a magnetic field. Heat transferred by radiation or other mechanisms from the plasma to the surrounding surfaces must be removed in steady-state operation if the surrounding surfaces are to maintain their structural integrity.

The use of a heat pipe to transfer heat efficiently from a hot location to a cold location is known in the art (See U.S. Pat. No. 2,350,348). Generally a heat pipe consists of a vacuum tight envelope, a wick structure and a working fluid. The heat pipe is evacuated and then back-filled with a small quantity of working fluid, just enough to saturate the wick. The atmosphere inside the heat pipe is set by an equilibrium of liquid and vapor. As heat enters the heat pipe at the hot end, (the evaporator), this equilibrium is upset generating vapor at a slightly higher pressure. This higher pressure vapor travels to the cold end (the condenser) where the slightly lower temperatures cause the vapor to condense giving up its latent heat of vaporization. The condensed fluid is then pumped back to the evaporator by the capillary forces developed in the wick structure.

The present inventors are aware of no prior art where thermal management of a helicon—especially antennas and ionization chamber tubing—is achieved through innovative use of heat pipes, coolant flow, heat exchangers, and/or thermally conductive materials with low RF dielectric losses such as CVD diamond. The present inventors are aware of no prior art where gas density and flow rate, antenna design, and magnetic field shape, including the choke design, are all optimized to move the hot plasma downstream for steady-state plasma source operation.

SUMMARY

A plasma source that ionizes gas and heats plasma using optimized RF antennas, applied magnetic fields, plasmas, coaxial gas confinement tubes, and waste heat management methods comprising means for carrying heat axially to a heat exchanger or heat sink for disposal.

BRIEF DESCRIPTION OF THE DRAWINGS

The present invention is illustrated by way of example, and not by way of limitation, in the figures of the accompanying drawings in which.

DETAILED DESCRIPTION

Figure 1:
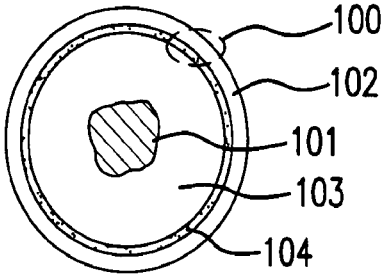
FIG. 1 depicts a cross section of a metal ring type antenna with a single layer of deposited thermally conducting material, in accordance with an embodiment of the invention.

In the following description, for the purposes of explanation, numerous specific details are set forth in order to provide a thorough understanding of the present invention. It will be apparent, however, that the present invention may be practiced without these specific details.

Overview

Certain embodiments of the present invention provide for efficient plasma stream production. Such a plasma stream is suitable for space propulsion. High efficiency in terms of total power utilization to produce the plasma is desirable for electric propulsion systems such as VASIMR engines. Another feature of certain embodiments of the present invention is the production of a plasma stream in one region with a subsequent flowing of that plasma into a different region for further modification of plasma properties. An apparatus in accordance with an embodiment of the present invention may have various uses other than space propulsion.

An apparatus in accordance with an embodiment of the present invention comprises a radio frequency (RF) based, gridless plasma source suitable for extracting plasma streams and subsequently tailoring the spatial and energy distribution of those streams. Such an apparatus could provide for control of the total plasma flux, the ionization fraction, the spatial distribution, or the energy distribution of the flowing plasma. Such control is useful for many applications in addition to VASIMR. Various embodiments of the present invention can be used for material surface modification, materials testing, waste decomposition, and other purposes.

Various gas species require a minimal amount of energy to ionize because of line radiation losses and the energy of ionization inherently stored when an electron is removed directly, or through a series of energy level steps, from a neutral atom at the ground state. For example, the minimum, averaged over all excitation channels, energy to produce an argon ion from the neutral ground state is roughly 40 eV. However, extraction and flow of these ions into a separate stage for further independent processing is significantly more difficult. For an RF plasma source that provides extraction and flow to a separate stage, ions can be extracted for energies between 40 and 100 eV each from a single ended RF plasma source to produce a flowing, quasi-neutral plasma stream. Simultaneous extraction from both ends to form two streams can be configured to approach the minimal energy cost values for ion production. Alternatively, the energy required to extract ions using traditional grid-extraction techniques is typically much higher than 100 eV and the extracted current density is greatly constrained by ion and plasma interactions with the grid itself. Gridless configurations do not have these gridded extraction limitations.

The helicon as a stand-alone plasma generator can efficiently ionize heavier propellants, such as Neon, Nitrogen, Argon and Xenon, as well as lighter propellants, such as Hydrogen, Deuterium, and Helium. Preliminary experiments with most of these gases have been conducted in Ad Astra's laboratory with significant success. Further experiments are planned that also include chemical mixtures such as ammonia.

Neutral gas is injected into the system by a propellant injection assembly (typically an off-the-shelf programmable mass flow controller) that delivers the appropriate flow of new propellant to the ionization chamber. There are important considerations that must be taken into account in accomplishing this function effectively as discussed below.

The gas flow rate in these systems can range from a few hundred standard cubic centimeters per minute (SCCMs) to thousands of SCCMS, depending on the type of gas and power being used. This is equivalent to a range from fractions of a milligram/second to several 10 s of milligrams/second. The gas is injected into a volume (the ionization chamber) which is initially at vacuum and rapidly achieves a steady state operating pressure ranging from a few tens of mtorr before ionization to up to 1 ton after the plasma is established. Operation in space can take advantage of the virtually "infinite" vacuum pumping capability of the natural environment, while an accumulation of downstream pressure requires adjustments for operation in terrestrial environments. The results in the laboratory vacuum chamber are adjusted to be representative of the expected behavior over a broad range of vacuum conditions and indicate that the axial distribution of the plasma and gas pressure will be strongly dependent on the ionization chamber and magnetic field geometry and affected by the plasma itself. Once the discharge is initiated, the magnetic field indirectly aids in the trapping of the incoming gas by creating a plasma plug downstream.

For space applications, a VASIMR 200 kilowatt experimental prototype, the VX-200, is envisioned to verify operation of a system qualified for space use. Variations in subsystem configuration that depart from this initial design are contemplated depending on the applications and are currently under study.

There have recently been four fundamental advances in the state-of-the-art. The first is the production of a quasi-neutral plasma stream from an inflowing stream of neutral gas using radio frequency coupling techniques. The second is the extraction of the flowing quasi-neutral plasma for further processing of that plasma and any additional neutral gas in the extraction region. The third is the optional tailoring of the energy distribution of the extracted plasma by additional RF heating that is selectively tailored to affect ions, electrons, or both. The fourth is the thermal management of various components to enable long-pulse or steady-state operation with minimal and/or controllable damage by plasma-surface interactions.

Figure 13:
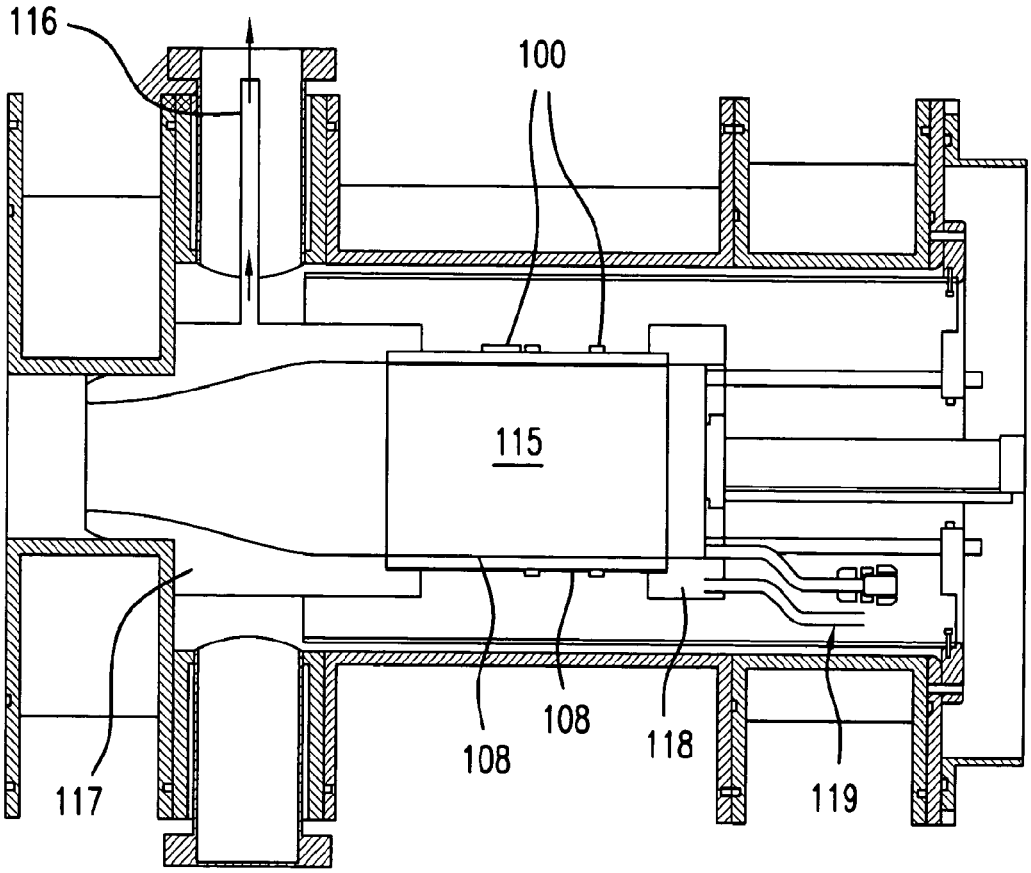
FIG. 13 depicts an ionization chamber comprising a gas containment tube that allows RF power to couple to the plasma inside the ionization chamber in accordance with an embodiment of the present invention.

Conventional magnetized RF discharges typically use a recycling fill of gas that allows neutral material to bypass the plasma ionization region, or they generate nearly stagnant plasmas surrounded by neutral gas. However, it is possible for a plasma source to allow the option of using multiple and/or simultaneous RF techniques at differing power levels to allow new regimes of electromagnetic operation. The first stage of such an ion source is capable of ionizing nearly any gas or vaporized neutral material. A first stage, in accordance with an embodiment of the present invention, could use a helicon-like RF source as is shown in FIG. 13. FIG. 13 depicts an ionization chamber comprising a flow inlet 119, an upstream manifold 118, a flow exit 116, and a gas containment tube 108 that allows RF power to couple to the plasma inside the ionization chamber 115. A choke restriction 117 downstream allows injection of the plasma stream into a region of increasing magnetic field while simultaneously blocking the flow of neutral particles around the ionization region. Depending on the neutral injection rate and RF power, this configuration allows conversion of up to 100% of the injected material into a plasma stream.

Figure 14:
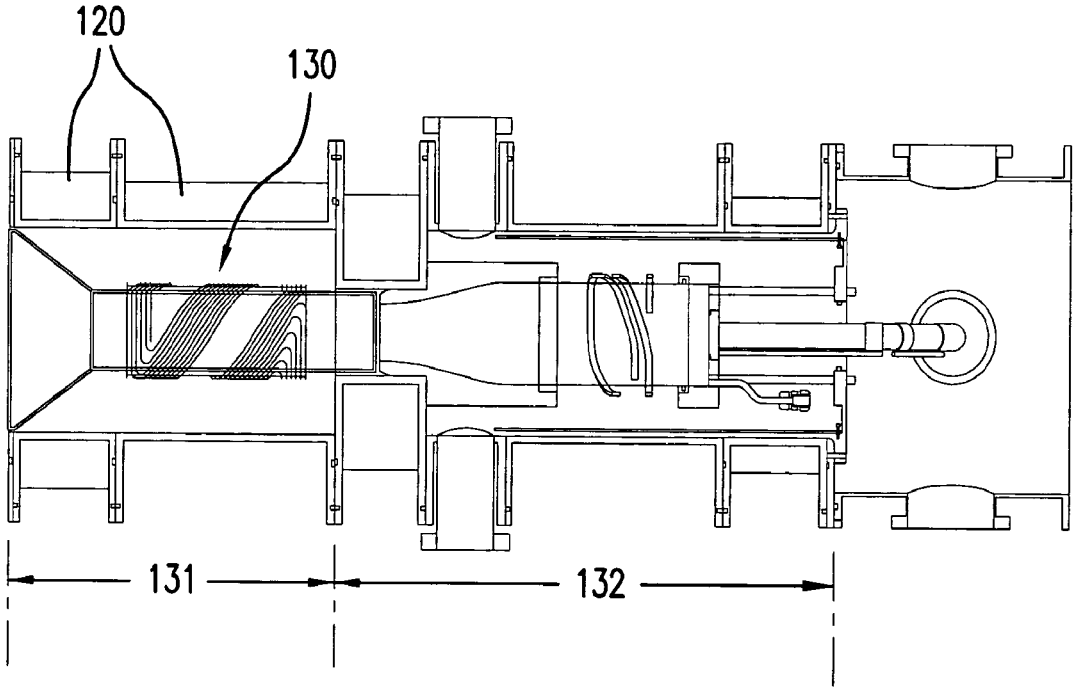
FIG. 14 depicts integrated first and second stages in accordance with an embodiment of the present invention.

The production of a flowing plasma stream that can be guided into and through a region of very high magnetic field strength allows a unique capability to further modify the energy content and distribution of the plasma stream with ICH for light or even heavy ion species. A helicon-like first stage 132 and an ICH second stage 131, further comprising an RF coupler for ions 130 and magnets 120, in accordance with an embodiment of the present invention, is shown in FIG. 14. First stage 132 and second stage 131 are integrated. This second stage 131 can operate optionally at very high magnetic field strength allowing efficient ICH acceleration of heavy ions.

Relative to conventional ionization sources, improvements to a plasma source stage 132, in accordance with an embodiment of the present invention, could comprise self-consistent integration of an electromagnetic RF coupler, a static magnetic field used to channel and contain the plasma flow, a neutral injection system, and/or thermal management systems. Embodiments of the present invention could comprise various combinations of these features. Such features could allow an embodiment of the present invention to operate in previously unobtainable regimes. For example, a new regime could efficiently develop a stable fully-flowing plasma stream by ionizing up to 100% of the incoming neutral gas or particles. Another novel feature made possible by such a comprehensive design is provision for control of plasma impact along field lines between the region of plasma production and the region where the plasma stream is utilized further downstream. Such control can allow the power and ionization efficiencies to be optimized in conjunction with the electromagnetic performance of the RF coupling system. Such features can also allow the lifetime of plasma-facing structural components in the source to be maximized by controlling ion impact on these structural components using static magnetic shielding. Furthermore, such features can minimize the introduction of impurities into the plasma stream from erosion of structural materials used to make the source.

For an ionization process in accordance with an embodiment of the present invention, a helicon-like system can be used for a first stage in which a concentrated pattern of RF electric fields are produced in a region of axial inhomogeneity. Such a configuration can self-consistently create a region of high electric field localized axially and near the center. This power heats electrons that ionize neutral gas primarily though electron impact ionization and excitation processes. Power dissipation is proportional to the square of the electric field, leading to damping of the waves near the axis in the region of wave convergence. To minimize gas throughput while maximizing plasma output, magnetic field geometry can somewhat counter intuitively be strengthened on the downstream end (the plasma outlet). Concentrating RF power in this converging magnetic field region causes much of the ionization to occur in the downstream section where plasma production is desired. Such a magnetic geometry also allows for a closely fitting solid wall to be protected from the plasma by the magnetic field, while forming a geometrical trap to contain gas, which is not affected by the magnetic field and might otherwise escape downstream without being ionized. Geometric trapping of the neutral gas can be especially useful during initiation of the plasma when high-vacuum conditions exist downstream of the source, such as those encountered in space.

Figure 15:
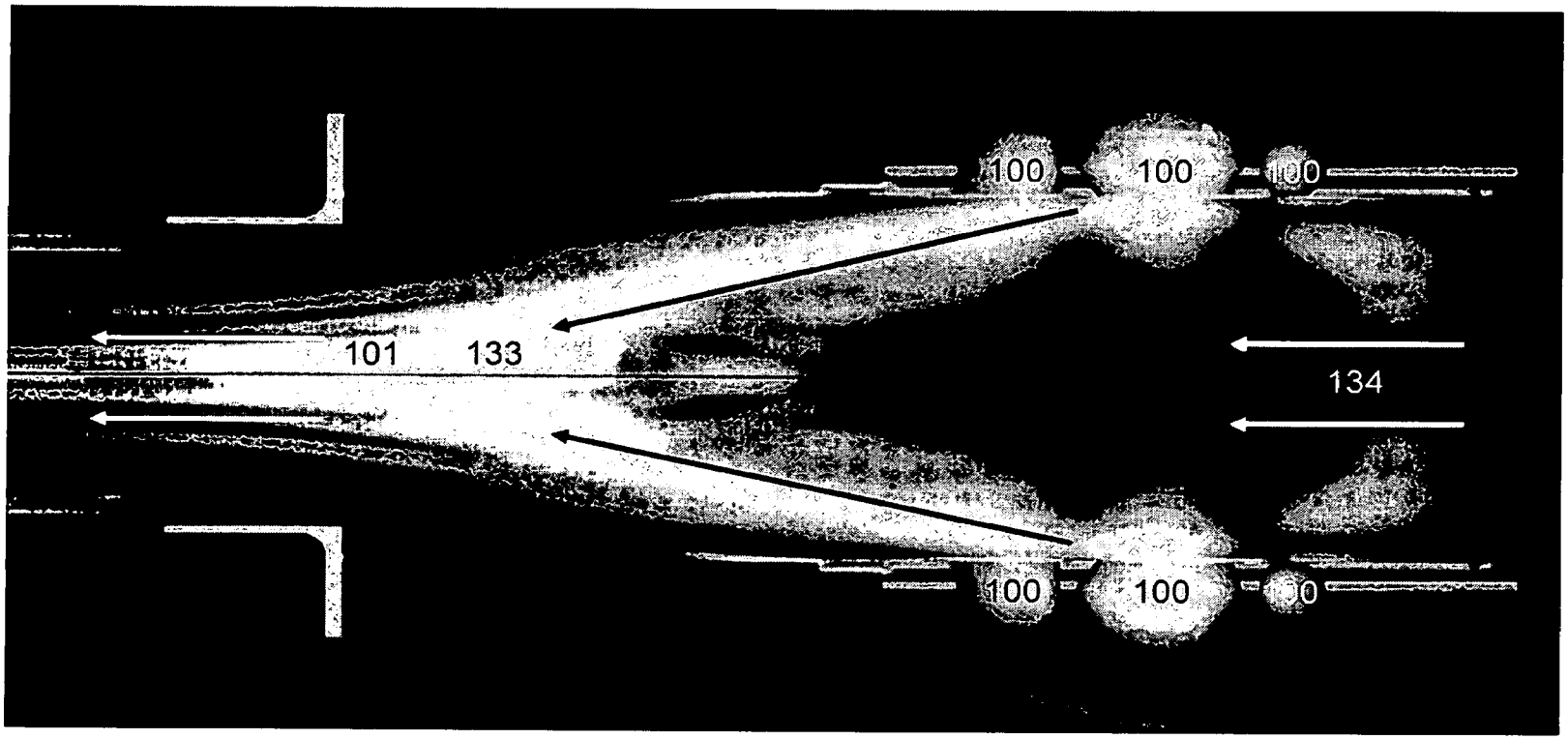
FIG. 15 depicts electromagnetic simulation of the ionization chamber using a helicon-like RF coupler.

An electromagnetic simulation in accordance with an embodiment of the present invention is shown in FIG. 15. This simulation demonstrates how the RF electric field enters the self-generated plasma in a way that simultaneously optimizes the RF coupling system while self-consistently maximizing the interaction of heated electrons in the plasma with the inflowing gas stream. The incoming gas 134 on the right flows through a region of high RF electric fields that are propagating through the plasma to concentrate in the downstream choke region on the left side of FIG. 15. The magnetic field strength is increasing in the choke region 133, modifying the plasma 101 dielectric properties in a way that is self-consistent with the RF coupler 100 to heat electrons in the plasma at the desired location for electron-neutral impact ionization. The plasma that is produced should remain consistent with the total coupled RF power and its spatial deposition profile according to the self-consistent plasma dielectric and the RF coupler 100 design. The coupler 100 is designed to concentrate the RF electric fields downstream under the choked region 133. These RF electric fields are responsible for plasma 101 production. Optimum and controlled ionization of the neutral stream to form a flowing plasma in the choke region is obtained by matching the RF coupler 100 design with the magnetic field variation (increased field strength in the choke region 133) and the structural support of the ceramic and choke components.

An embodiment of the present invention could also allow injection of the plasma stream into regions of static magnetic field with a wide range of field strengths including much higher magnetic fields than previously possible. Plasma sources lacking features of the present invention could be limited when operating in high magnetic fields because of instabilities and/or the loss of control of the plasma that is produced. Methods and apparatus in accordance with the present invention can provide for stable operation with either stagnant or flowing plasma at very high throughput using very high static magnetic field strengths. High magnetic field strengths allow efficient modification of the ion energy distribution in a second stage using a second RF technique based on ion cyclotron resonant (ICH) interactions between the ions and RF waves in the plasma, even for heavy ions. Stable, high density and high plasma flux conditions have been experimentally demonstrated well in excess of 1 Tesla with a plasma source in accordance with an embodiment of the present invention, and operation at much higher fields is possible. Very high overall power efficiency for high magnetic field is possible for embodiments of the invention using super-conducting magnet coils. Embodiments of the present invention using combinations of super-conducting and/or conventional magnet coils, and/or permanent magnets, and/or materials with high permeability are also possible depending on overall design requirements for the system.

Overall power efficiency is useful for energy conservation in all applications and especially so in space applications. This efficiency must include the technology required to generate the RF power. An ionization stage in accordance with an embodiment of this invention allows the use of RF power in a frequency regime well below the FM and industrial 13.56 MHz frequencies that are typically used in other helicon-like discharges. The ability to use frequencies much less than 13.56 MHz allows the use of solid state, or other amplifiers that are very efficient in converting DC to RF power. The ability of an embodiment of the present invention to operate at lower frequencies is useful for minimizing total power consumption required to ionize the neutral feedstock and to generate the desired plasma properties. An embodiment of the present invention having a choke region geometry similar to that shown in FIG. 13 enables the use of lower frequencies. In an embodiment of the present invention having such a choke region geometry, the static magnetic field and the plasma density change axially to allow the electromagnetic waves to concentrate near the center of the device as shown in FIG. 15. Adjustments to such an embodiment's RF coupler design and gas injection system allow control over the spatial power deposition, and subsequent plasma production in the device.

In accordance with an embodiment of the present invention, optimizing the design of various components both separately and synergistically allows advances that are not possible with previous plasma source technologies. These features allow optimization and integration of the electromagnetic coupling configuration, the static magnetic field geometry, the structural components, the gas injection system, and/or thermal management systems. Features of certain embodiments of the present invention are organized and expanded upon below. The first discussed relate to the basic electromagnetic design. Second is integration to exploit synergies between any of the following: electromagnetic design, static magnetic field geometry, structural components, and gas injection. Third comes integration of compatible thermal management to improve long-pulse or steady-state operation.

Electromagnetic Design

For electromagnetic wave geometry in accordance with an embodiment of the present invention, low frequency waves do not typically propagate far from the launching structure without the presence of the plasma, which is produced self-consistently by absorption of those waves. Plasma dielectric properties are nonlinear in terms of the coupled RF power, which in turn affects the geometry of plasma dielectric required for the coupler to function efficiently. The magnetization of the plasma further complicates its dielectric properties and introduces strong asymmetries compared with communications or other applications with relatively simple dielectrics. The plasma response must be represented by a full dielectric tensor that is dependent on the coupled RF power. Thus, an RF coupling design in accordance with an embodiment of the present invention is more complicated than an antenna used in the traditional communications, radar, or simple dielectric heating applications. Rather, an RF coupler in accordance with an embodiment of the present invention performs an antenna-like function only in the presence of the self-consistent plasma state produced by the coupling system. Furthermore, plasma cannot typically come into contact with the current carrying components of the coupler without shorting it out. The effects of non-radiated near-fields play a critical role in the initiation of the plasma and in the efficient coupling of the RF power across an evanescent gap. Winding techniques, more akin to those used for transformers can greatly improve an RF coupler's performance in coupling power to the plasma. This performance is affected by the effective plasma resistive load in the RF circuit. Winding an antenna also modifies the inductance of the overall circuit that is used to resonate the antenna. Thus, an RF coupling system in accordance with an embodiment of the present invention shares certain characteristics of a transformer, an inductive circuit element, and an antenna. The geometry of the self-consistently produced plasma in a static magnetic field also plays a role in determining the coupling of electromagnetic waves and the required geometry of the launching structure. Although an RF coupling system may sometimes be referred to as an "antenna" by analogy and for simplicity, the actual integrated RF coupling process with plasma is much more complex than processes exemplified by typical antenna applications.

Figure 16:
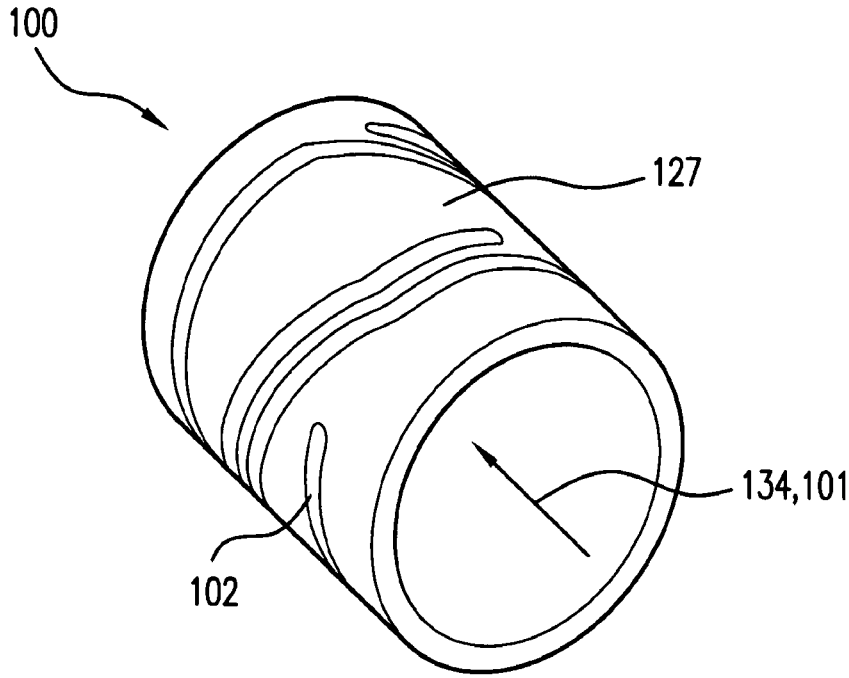
FIG. 16 depicts a wrapped antenna geometry for simultaneously enhancing the power coupled to the plasma and increasing the inductance of the circuit to allow tractable capacitor designs with voltage limits that can be tolerated in the overall circuit in accordance with an embodiment of the present invention.

FIG. 16, shows an electromagnetic design for plasma coupling comprising additional wraps of RF conductor 102 in a geometry optimized for the desired final plasma state. In this embodiment, the antenna 100 is a layer of highly conducting material 102, at least a few RF skin-depths thick, wrapped in a helical pattern around an electrically insulating structure 127 to increase both the plasma loading resistance and the inductance of the circuit. Increasing the inductance allows the use of smaller capacitors and/or lower frequencies than are otherwise reasonable while not requiring additional lossy inductors that reduce the efficiency of the circuit without enhancing the plasma coupling. Such an embodiment also allows a conductive thermal path with an optional thermally conductive, electrically insulating sleeve (not shown) to conduct excess heat to a heat sink in applications requiring long-pulse or steady-state operation. The frequency, the direction of the helical pitch of the winding, and direction of the static magnetic field help to determine whether the RF power couples primarily to positively or negatively charged particles in the plasma. The geometry of the coupler can help control how much RF power is absorbed by the different charged species in the plasma.

Figure 17:
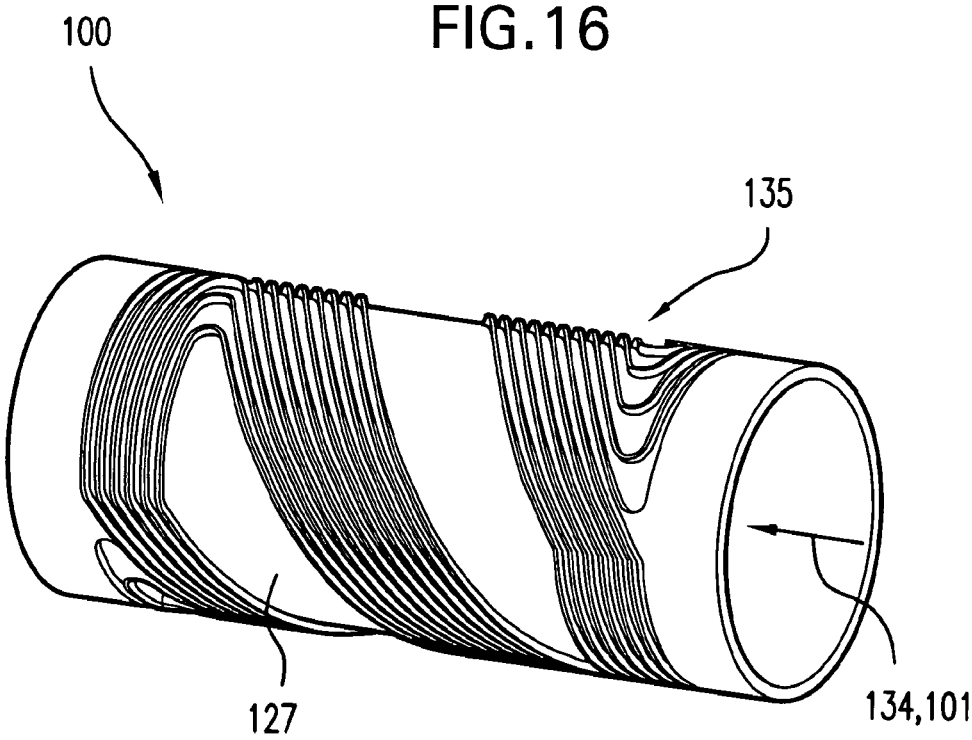
FIG. 17 depicts a mandrel having wraps to enhance plasma coupling and inductance in accordance with an embodiment of the present invention.

Another embodiment of the present invention comprises an RF coupler comprising an electrically insulating winding mandrel 127 having channels 135, as shown in FIG. 17. Said mandrel 127 can be tailored for use at low frequency to minimize capacitor requirements, maximize plasma 101 coupling, and minimize resistive losses in the conductor by using high surface conductivity conductors and/or Litz wire. The extra length of conductor used increases Joule resistive losses in the conductor itself. In this embodiment, the conductor is wound in a channel manufactured in an electrically insulating mandrel. The conductor can be hollow or solid tubing or other types of conductor. At low enough frequencies for wire strand production, Litz wire can be used to minimize resistive losses from RF dissipation in the skin-depth of the conductor. In this embodiment, conductive cooling is used to manage thermal requirements for pulsed or steady state operation. The frequency, the direction of the helical pitch of the winding, and direction of the static magnetic field help to determine whether the RF power couples primarily to positively or negatively charged particles in the plasma. The geometry of a coupler can help control how much RF power is absorbed by the different charged species in the plasma.

The (helicon) RF antenna launches electromagnetic waves into the ionization chamber to provide the basic plasma source. These waves interact with the background gas and produce an ionization cascade. Once a plasma is formed, the waves couple primarily to electrons in the plasma, which ionize the gas primarily by electron impact, generating dense (10 raised to the 20th power particles per cubic meter) and cold (electron temperature of 5 ev and ions at room temperature) plasma. The wave power must be efficiently absorbed by the self generated plasma so that the "cost of ionization," typically measured in ev/electron-ion pair, is operationally acceptable and does not levy an undue tax on the overall power budget for the system. Operation can also be constrained by the removal of the wasted energy from the walls of the ionization chamber and other system components. Our studies indicate that ionization costs above 200 ev/e-i pair would result in generally low efficiency for rocket applications in space, but may be acceptable for many terrestrial applications. Present designs and experimental results with Argon indicate ionization costs of less than 100 ev/e-i pair can be achieved. Ionization costs improve with higher power.

The helicon waves propagate from the antenna radially inward and downstream towards the axis of the ionization chamber. As they do so, they are absorbed by the plasma (damping mainly on the electrons). The wave absorption can be influenced by the local gas/plasma pressure so, depending on the application, it is important to insure that optimal conditions exist downstream of the helicon antenna for the wave energy to be readily absorbed while simultaneously delivering the desired plasma downstream.

The RF subsystem comprises the RF transmitters, the impedance matching circuits, the transmission lines and the RF antennae. Both solid state and tube-based RF technology are used in the laboratory and for terrestrial applications. All solid state technology will be used for the VX-200, the first flight-like version of the VASIMR. These will now be discussed sequentially.

The RF transmitters convert input DC power at moderate voltages (a few hundred 5 volts) into RF power that is delivered to the plasma by the antennae.

The basic building block of the RF system is a Metal Oxide Silicon Field Effect Transistor (MOSFET) module capable of up to a kilowatt of power. These units have been produced commercially for the AM radio market and other applications. These units are driven in clusters and integrated in sub-modules that, together, reliably generate the required RF power. Two such modules will drive the helicon and ion cyclotron stages respectively. The RF transmitters will operate at two different frequencies to power the helicon and RF booster stages respectively.

Impedance matching between the source and the load is required to efficiently couple the RF power to the plasma. This is accomplished by tuned transmission lines with a possible intermediate matching circuit with the appropriate capacitance and inductance. Because perfect matching may not be practical throughout the plasma startup and/or other transients, the transmitter module and related circuitry must be robust enough to tolerate brief (millisecond) off-match conditions where the power reflected back into the source may be considerable. Moreover, if off-match conditions persist because of other fault or off-normal conditions, the transmitter system should be capable of automatic shutdown with no damage to the hardware. These features are feasible with modern RF technology.

A transmission line, typically an insulated high voltage coaxial central conductor sheathed in a grounded outer jacket, or a stripline delivers the RF power to the antenna. To minimize line losses, the transmission line should be as short as practical, putting the RF system as close as possible to the plasma. It should also incorporate impedance characteristics that assist in the matching process.

The helicon antenna transmits power to start-up the plasma and heats the plasma which further ionizes the gas in the ionization chamber. This plasma can then be used for the desired application. In the VASIMR system or any application requiring further plasma heating, the plasma moves downstream to the ion cyclotron resonance antenna.

The ion cyclotron resonance antenna is the core of the VASIMR second stage, also known as the "RF booster." The antenna launches ion cyclotron waves onto the flowing plasma. The waves damp by resonating with the cyclotron motion of the ions, a well known plasma heating mechanism used in controlled fusion research. The waves are launched in a region where the natural cyclotron frequency of the plasma ions is above the wave frequency, as a result, the waves do not damp on the surface of the plasma but are able to penetrate radially inwards as well as propagate downstream to a region of lower magnetic field where the wave frequency does match the ion cyclotron frequency exactly. This axial position is called the cold resonance and waves are able to couple energy to the plasma beyond this point. In practice however, the actual resonance differs somewhat from the cold resonance due to Doppler effects caused by the plasma flow velocity.

Some of the wave energy in the second plasma heating stage of systems that require such heating is also delivered to the plasma electrons. The partition of wave energy between ions and electrons is driven by antenna design features, such as the antenna length, twist and number of straps. While the RF power given to the electrons is not considered useful in our calculations of rocket performance for VASIMR, the electron heating may indeed provide useful thrust by increasing the electron temperature and hence the "ambipolar" electric field that is naturally established by the physics requirement that the ions and electrons leave the system at the same rate. As a consequence, the calculations of rocket performance are considered conservative estimates.

One unique aspect in the present VASIMR configuration is the delivery of the RF energy in a single ion pass through the system. This is in contrast to classic ion cyclotron heating, which relies on multiple ion passes under the antenna field as they bounce in a magnetic well. The present VASIMR RF booster does not require such trapping and has demonstrated sufficient wave energy absorption in a single ion transit thus rendering a considerably simpler magnetic structure.

The helicon antenna twist, length and diameter are design parameters that stem directly from AARC's plasma models as well as experimental results from the physics demonstrator experiment. The efficient operation of the antenna also depends on the magnetic field geometry and the plasma density.

There are important considerations on the installation of the antenna that have a bearing on potential plasma bombardment and erosion onto the insulating inner surface of the plasma chamber. This effect is produced by high voltages associated with plasma sheath rectification. There are a number of simple design and antenna assembly measures that can be implemented in accordance with an embodiment of the invention to reduce these effects. These include mounting the antenna onto the dielectric with a small physical separation, which increases its stand-off voltage capability. In addition, the antenna resonant circuit can be designed with a "floating ground" that can greatly reduce the sheath voltage issue. Other measures include the use of Faraday shields to reduce direct electron bombardment onto the antenna straps.

A problem with having a solid metal antenna is that the RF is only carried near the outer surface giving locally very high current densities and the rest of antenna cross-section is wasted. In accordance with an embodiment of the invention, a LITZ wire weave (an oblong bundle of micro wires) can be used in the ICRH antenna—perhaps also in the helicon antenna in the future, though the frequencies in the helicon may typically be too high for LITZ wire. The weave should route wire from inner surface to outer surface so that RF currents can be distributed over the entire cross section of the current carrying material. This wastes less RF power in the antenna and yields more ions per Joule. A thermally conductive electrical insulator, such as aluminum nitride, can be used to carry heat away from a Litz wire pack.

The ICRH antenna twist and number of straps and proximity to the plasma are important considerations in a successful design. The antenna loading is strongly dependent on the total antenna current as seen by the plasma and its proximity to it. Since the antenna current only flows on the surface of the conductor, one way to maximize loading in accordance with an embodiment of the invention is through the radial layering of very thin antenna straps embedded in an insulator matrix. Ad Astra Rocket Company has begun testing experimental versions of these designs in the physics demonstrator experiment in Houston. Initial experiments with Argon have shown promising results. In general: the greater the number of straps, the greater the plasma loading.

Also, by increasing the twist of the straps one can increase (at the expense of loading) the energy coupled to the ions. Proximity to the plasma also increases the plasma loading but can lead to greater damage to the antenna structure due to plasma bombardment and heating. These physics considerations play an important role in the engineering of the system and are carefully evaluated when making design choices. The design team makes considerable use of AARC's plasma models and experimental results from the physics demonstrator experiment in carrying out design optimization of all these parameters.

Integrated Electromagnetic and Plasma Flow Design

High performance and high efficiency of the source can be achieved by exploiting synergies between the RF wave pattern that is excited by a coupling device and the plasma that is produced by the absorption of RF power from this wave pattern. An integrated approach is used to design an RF coupler so that it remains compatible with other constraints while meeting the demands of the desired application, and especially those for the VASIMR application. The dielectric response of the plasma depends on the plasma that is produced, which thereby affects the wave pattern that can be efficiently excited. The initiation of the plasma depends on the ability of an RF coupling system to couple relatively small amounts of power during imperfect transient conditions until the self-generated plasma can evolve into the intended configuration. This configuration is also affected by device geometry, static magnetic field conditions, and by the electromagnetic design of the RF coupling structure. The final plasma-electromagnetic coupling state can be tailored to suit the specific needs of the application.

An integrated embodiment comprising a first stage used to ionize the incoming neutral gas stream and direct its flow into a region of high magnetic field is shown in FIG. 13. The field lines are directed to minimize ion surface interaction with the structural components. Magnetic fields at the choke region can exceed 1 Tesla with nearly complete ionization of the incoming neutral stream. The RF coupler design is integrated with the magnetic field geometry as well as the ceramic and structural choke design to optimize RF power coupling efficiency. A plasma source according to an embodiment of the present invention could comprise one or more RF coupling systems, magnetic fields, gas injection system, and vacuum tight gas containment tubes. A plasma source according to an embodiment of the present invention could comprise a fluid cooled RF coupler (helicon antenna). A plasma source according to an embodiment of the present invention could comprise a second stage for accelerating ions within the plasma stream.

A key factor in antenna performance is overall helicon geometry. A counter intuitive benefit of a helicon configuration is that it produces much of the hot plasma downstream of the helicon antenna in the region of increasing magnetic field. A stronger magnetic field downstream of the antenna creates a narrow chokepoint that the plasma and gas must flow through. It also changes the characteristics of the RF waves in this region. Most physicists would expect the magnetic pinch to push the hot plasma upstream, but instead it works in a fashion analogous to a lens to focus the plasma production downstream where the ambipolar potential and gas pressure push the plasma through the magnetic choke. This effect is a feature of the high flow, high power, and high efficiency helicon. It is a key design driver in the helicon. Gas density and flow rate, antenna design, and magnetic field shape are all optimized to move the hot plasma downstream. Depending on the application, for the optimum magnetic pinch geometry, the ratio of the field strength at the choke point to the field strength at the helicon is usually greater than two, and is typically 4 or 5.

An integrated plasma source according to an embodiment of the present invention, as shown in FIG. 13, could comprise means for producing an RF electric field wave pattern such as the one shown in FIG. 15 to position the region of plasma production 133 downstream away from the upstream injection of the neutral feed stock 134. Moving plasma production downstream helps to protect the upstream surface, shown in FIG. 13, from plasma 101 impingement, thereby improving source performance.

An integrated plasma source according to an embodiment of the present invention comprising a helicon-like first stage 132 and a second RF system 131 suitable for ion cyclotron resonance heating of the flowing plasma stream, is shown in FIG. 14. The energy distribution of the ion species can be adjusted in this section to meet the requirements for the plasma after passing through both stages of the source. Note that for an embodiment of the present invention optimized for VASIMR-type applications, the helicity of the ICH coupler winding 130 is preferably opposite that of the helicon-like coupler shown in the first stage so that the wave polarizations are configured to heat electrons in the first stage 132 at helicon-like frequencies, but to heat primarily ions in the second stage 131 at ICH frequencies. The direction of the static magnetic field provided by the magnet system determines the relative pitch of the antennas for optimum performance under VASIMR-relevant conditions.

These systems rely on a DC magnetic field to produce, confine, guide and accelerate the plasma. For space applications or any application that requires minimal power consumption, this field is produced by a cluster of superconducting electromagnets. Superconducting magnets can be manufactured commercially by a limited number of companies worldwide.

The VASIMR magnet comprises four sub assemblies: (1) the helicon first stage magnet, (2) the choke coil, (3) the ICRH or booster magnet and (4) the nozzle magnet. Design of these space-relevant systems requires careful evaluation of thermal and structural issues within a package of manageable weight. Terrestrial applications may not be so restricted and can be water cooled, although advanced, space-relevant solutions may still be used if they are economically viable.

The helicon magnet is an integrated assembly of magnet coils designed to provide minimal plasma interaction with the walls of the ionization chamber. A smaller diameter thermal shield is used as a 300° K. barrier for superconducting magnet designs, enabling the cryostat to handle the low cryogenic temperatures of the magnet through a cryogenic thermal management system. The helicon field is typically less than 1 Tesla hence the magnet can be rather long and thin. The two magnets, when combined with the choke magnet, produce the required field profile near the helicon antenna. Superconducting magnets typically require that they be attached to other parts of the system by struts with low thermal conductivity.

The choke magnet is a short annular structure producing the highest field in the system, and may generate fields of 1 Tesla or more depending on the application. This field has two purposes: (1) separate the helicon plasma from the ICRH by means of the high magnetic mirror and (2) provide a narrowing of the plasma column to fit inside the ICRH antenna at the proper density for RF absorption. The choke magnet works with the RF booster magnet to provide the magnetic beach where the ion cyclotron waves are absorbed.

The booster magnet is a longer solenoid structure producing a fairly flat axial field profile at high magnetic field. The booster magnet encloses the ICRH antenna and is designed to provide sufficient absorption of the RF waves in the flowing plasma for applications that require additional heating beyond that provided by the helicon source.

Transition coils may also be needed to tailor the plasma exhaust for a specific application. In the case of VASIMR, the transition is performed by a magnetic nozzle to properly shape the field for (1) efficiently convert the ion perpendicular motion into axial motion and hence useful thrust and (2) provide sufficient expansion of the of the field to enable effective detachment of the plasma (and the field) from the portion of the field that remains attached to the rocket. Considerable experimental research is currently ongoing on the topic of detachment. Our present models are able to predict nozzle performance under a variety of approximations, conditions and magnet geometries. The nozzle magnet may be designed as a single unit or as an assembly of discrete rings that will provide the appropriate field shaping.

An additional key driver in the plasma source design is the alignment of the magnetic field tangential to the components of the system. This alignment minimizes the heating and erosion from plasma impingement on the surfaces of the source components.

Geometry is optimized for a particular gas. Magnetic field strength at the helicon antenna is matched to the size of the ionization chamber. One option to allow the use of different fuels in a VASIMR engine is to swap the ionization chamber for one sized for a different gas and then change the geometry of the magnetic field to match the new chamber, then adjust overall magnetic field geometry to optimize it for the new gas. A preferred embodiment would have the entire engine optimized for a particular gas, but allow for cartridge changes and magnetic field adjustments to use different gases.

Moving hot plasma downstream allows the gas injection plate/lid to be moved closer to the helicon antenna, and can provide flexibility for the materials to be used. Dense gas blocks ions from hitting the plate. Moving the gas injection plate shortens the magnet and reduces overall engine length and weight for space applications. Adjustments of the plate position can also change the gas flow characteristics through the system, depending on the application and method used for gas injection.

The solid choke that keeps non-ionized gas in the helicon to get a higher ionization percentage can be made of ceramic, metal, or other materials depending on the application's requirements.

The helicon antenna twist, length and diameter are design parameters that stem directly from AARC's plasma models as well as experimental results from the physics demonstrator experiment. The efficient operation of the antenna also depends on the magnetic field geometry and the plasma density.

A possible propellant starvation is believed to be caused by relatively hot plasma being created from the relatively cold feedstock gas. This condition is promoted by the higher transport velocity of the plasma compared to that of the cold gas. In order to reduce this effect for some applications, we may "force feed" the propellant directly to the location where it is needed rather than allowing it to flow on its own from the upstream axial injection point currently in use. Proper gas injection may reduce ionization cost and hence increase efficiency for some regimes of operation.

Referring to FIG. 1, a gas or plasma stream 101 flows through the center of the antenna 100. A vacuum 103 exists between the stream 101 and the antenna 100 because of the action of magnets (not shown) acting on the stream 101. This vacuum 103 prevents most conduction and convection from the target gas 134 and plasma 101. A ceramic or dielectric tube or heat pipe (neither is shown) might occupy some of the space of the vacuum 103, but it is not essential for this invention. In accordance with an embodiment of the invention, a layer of thermally conducting material 104 is deposited on the surface of a metal ring 102 to form the antenna 100. More specifically, the method of forming the antenna could be to first form the metal substrate of the antenna and use a chemical vapor deposition process to build up a layer of diamond on the metal substrate. Alternative thermally conducting materials 104 include quartz, aluminum nitride, combinations of the aforementioned materials, and other thermally conductive materials. The metal substrate 102 could be copper, silver or some element or alloy with similar or superior thermal and electrical properties. The metal substrate may also be joined to the thermal conducting material by electroplating. Because strap voltage is low, the straps can be very thin. It is desirable that the current flowing through the strap be as close to the plasma as possible.

Figure 7:
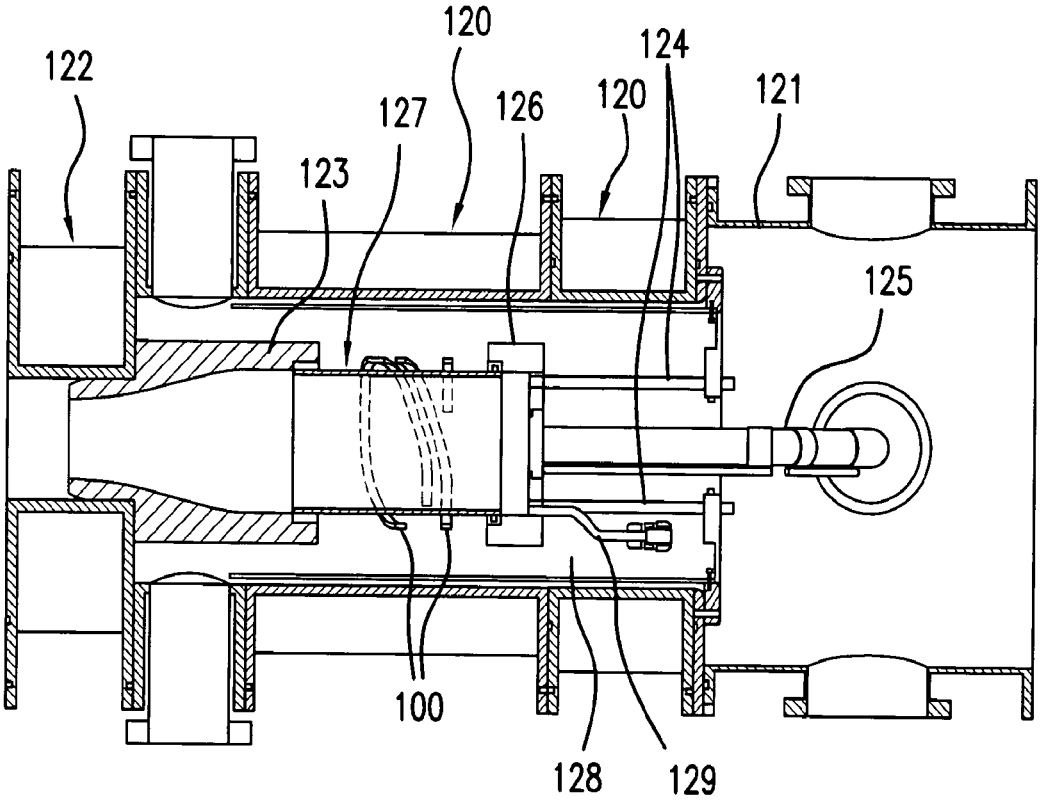
FIG. 7 depicts a cross section view of a VASIMR helicon, in accordance with an embodiment of the invention.

Referring to FIG. 7, a cross section of an entire helicon in accordance with an embodiment of the invention is shown. The helicon handles the main injection of propellant gas and its ionization. The Vacuum Vessel 121 simulates space conditions and creates an insulative vacuum. Helicon End-Plate 126 contains gas at the forward end of the gas containment tube 127. Helicon End-Plate support and Insulation Rods 124 provide structural support and insulation for the Helicon End-Plate 126. The propellant feed tube 129 feeds gas into the gas containment tube 127. The coaxial RF conductor 125, sheathed in a grounded outer jacket, delivers the RF power to the antenna 100. The antenna directs power to the target gas to create plasma. Helicon Magnetic Field Coils 120 keep the hot plasma in the center of the Gas Containment Tube 127. The Thermal Jacket 128 keeps heat away from the magnets 120, which may be cryogenic. The Metal Choke 123 channels ionized gas through the magnetic choke that is generated by the Choke Magnetic Field coil 122. The magnetic choke functions as a plasma lens to produce plasma downstream, and modifies the deposition of RF waves in this region.

Figure 8:
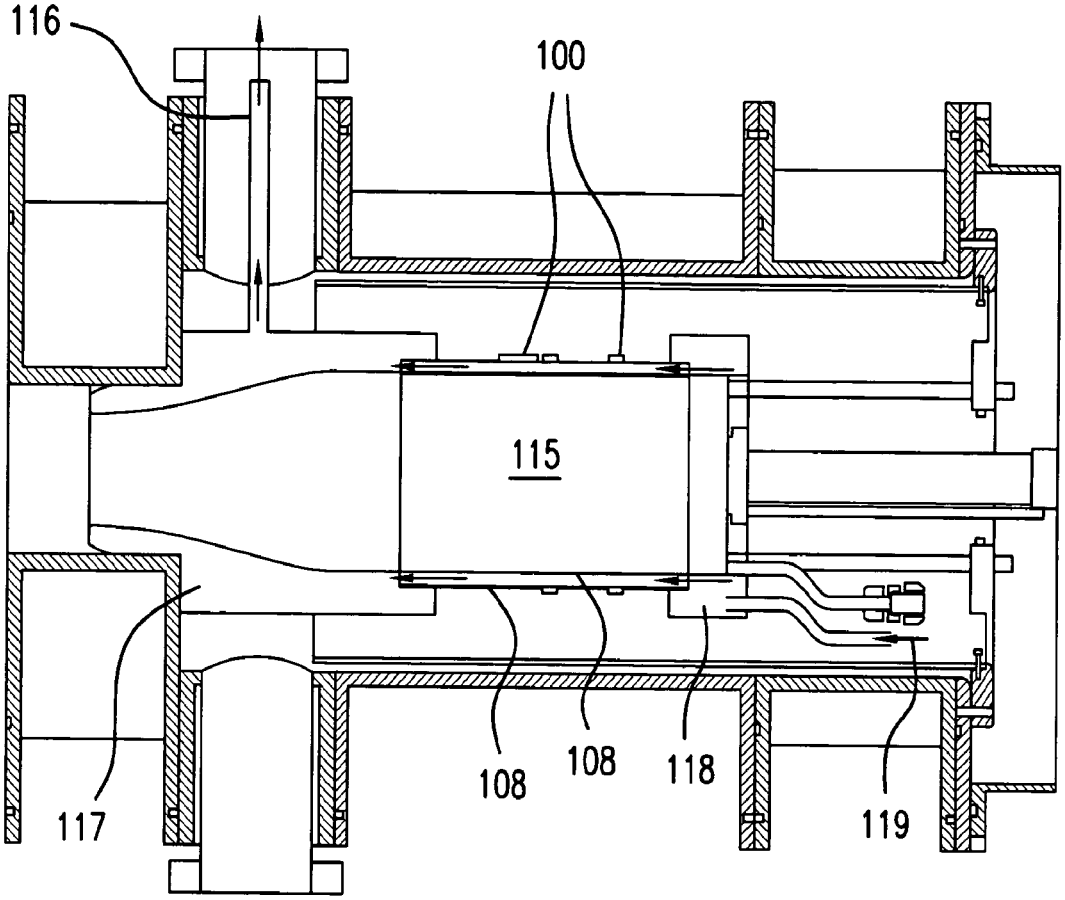
FIG. 8 depicts a cross section view of a VASIMR helicon wherein coolant flows between annular tubes that surround the ionization chamber, in accordance with an embodiment of the invention.

Referring now to FIG. 8, a cross section of an entire helicon in accordance with an embodiment of the invention is shown. This embodiment differs from the one in FIG. 7, by additionally comprising annular tubes 108 around the ionization chamber 115. RF compatible cooling fluid flows from a flow inlet 119 and axially through the space between the annular tubes 108 to the flow outlet 116 to a heat exchanger.

Integrated Thermal Management

The VASIMR presents several thermal challenges to the designer as heat must be removed at various temperature ranges. The subsystem is envisioned to encompass three distinct temperature ranges: high, intermediate and cryogenic.

The construction of an RF coupling structure and thermal management can be achieved by various active and/or passive means. Waste heat generated by an RF circuit can be minimized by using materials that are good conductors of RF. For frequencies low enough to take advantage of Litz wire's enhanced RF conductivity, very high efficiency can be achieved using multiple wraps of Litz wire to minimize Joule heating of the RF coupler by distributing the RF current over the cross section of the Litz wire. The wrapping of the coupler also determines the inductance of the antenna, allowing control of the remainder of the resonant circuit design for the second stage.

Convective cooling, such as by air surrounding the system is a possible cooling option for some plasma sources according to certain embodiments of the present invention. However, such traditional cooling is not always compatible or available for some applications. A plasma source according to an embodiment of the present invention may comprise alternative solutions for actively and/or passively cooling the source components during long-pulse or steady-state operation.

In one embodiment of the invention, the metal antenna is simply covered on at least one surface with a diamond film layer using a chemical vapor deposition (CVD) process. The metal portions of the antenna can thus be protected because heat can be quickly conducted through the diamond layer. Although other materials, such as quartz or aluminum nitride, could be used, diamond is desirable because of its combination of unique physical properties including an extremely high thermal conductivity and transparency to the RF energy being supplied to the gas stream. The heat carried away from the antenna may be disposed of remotely through any type of heat exchanger.

In further embodiments, the antenna may have alternate geometries: The entire antenna may be embedded in a hollow cylinder made of either diamond or other RF compatible ceramics; the antennas may have various numbers of straps and twists; the antennas may be made of woven LITZ wires; the straps themselves may have rectangular or alternate cross sections; and any number of surfaces on the straps may be covered with a thermally conducting layer.

In another embodiment of the invention, the antenna 100 may comprise a plurality of metal substrate layers 102 alternating with layers of thermally conducting electrical insulators 104. The thickness of the substrate 102 and thermal conductors 104 may be varied as necessary to achieve optimum levels of heat transfer and delivery of energy to the gas stream 134. Voltage through the electrically insulating layers 104 is low, so they could be made very thin.

In further embodiments, the antenna may have alternate geometries: The entire antenna may be embedded in a hollow cylinder made of either diamond or other RF compatible ceramics; the antennas may have various numbers of straps and twists; the antennas may be made of woven LITZ wires; the straps themselves may have rectangular or alternate cross sections; and any number of surfaces on the straps may be covered with a thermally conducting layer.

A plasma source 100 according to an embodiment of the present invention comprising an integrated thermal management solution using conduction cooling through thermally conductive, electrically insulating material 127 is shown in FIG. 16. Such an embodiment can be used for applications that require long-pulse or steady-state operation without the use of fluid cooling loops in either the first or second stages. An alternate embodiment could comprise an RF antenna for heating gases or plasmas comprising: a thick film of RF conductor 102 formed on an electrically insulating gas containment tube 127, an outer layer thermally coupled with compliant material 127 to conduct waste heat radially from the system to a heat exchanger.

A plasma source according to an embodiment of the present invention comprising an integrated thermal management solution using conduction cooling of a mandrel 135 used for winding the RF coupler is shown in FIG. 17. For low enough frequencies, Litz wire can be used to minimize the Joule heating of the conduction, thereby improving the thermal performance of the system. Such a Litz wire embodiment can be used to extend pulse times, typically in the second stage of a two-stage plasma source according to an embodiment of the present invention. A plasma source according to an embodiment of the present invention comprises an RF coupler for ion acceleration within the plasma stream is shown in FIG. 17 comprising: a passive winding and thermal management structure 135 to support an RF conductor (for example, Litz wire) to remove waste heat to an external heat exchanger. An additional electrically insulating sleeve can be in thermal communication with this support structure to add a radial path for heat transfer to an external heat exchanger.

As shown in the article titled "Comparing experiments with modeling for light ion helicon plasma sources" in Physics of Plasmas Volume 9, Number 12, page 5097 (2002), the RF antennae are typically helical conducting straps integrated in an insulated sleeve that also serves as the primary gas chamber. The antenna conductor may be actively or passively cooled to remove resistive (I2 R) power losses and heat soak-back from the plasma chamber itself. Because the circuit resistive losses are dependent on temperature, keeping the antenna straps as cold as possible is highly desirable. The key performance parameter for coupling RF power to the plasma is referred to as the "antenna loading." In that sense, the plasma represents a desirable resistive load onto the resonant circuit.

If the structural support and conductor cooling are provided otherwise, the antenna straps need not be unnecessarily thick. Rather, since RF currents only propagate within one skin depth of the conductor surface, in accordance with an embodiment of the invention, the conducting straps could literally be "painted" on the insulator substrate. These generally involve very thin conducting straps deposited on an insulator substrate. In accordance with an embodiment of the invention, multiple layers are also being considered to maximize the antenna current near the plasma. At the present time aluminum nitride appears to be an acceptable candidate for insulator substrate with gold as the potential conductor material. The assembly could be cooled passively by conduction heat transfer or actively by a flowing liquid or gas. The materials issues are critical in these designs, as their operating temperature can affect the I2R losses as well as the so called loss tangent, a measure of the RF power absorbed by the material itself (which ultimately also ends up as waste heat).

Figure 18:
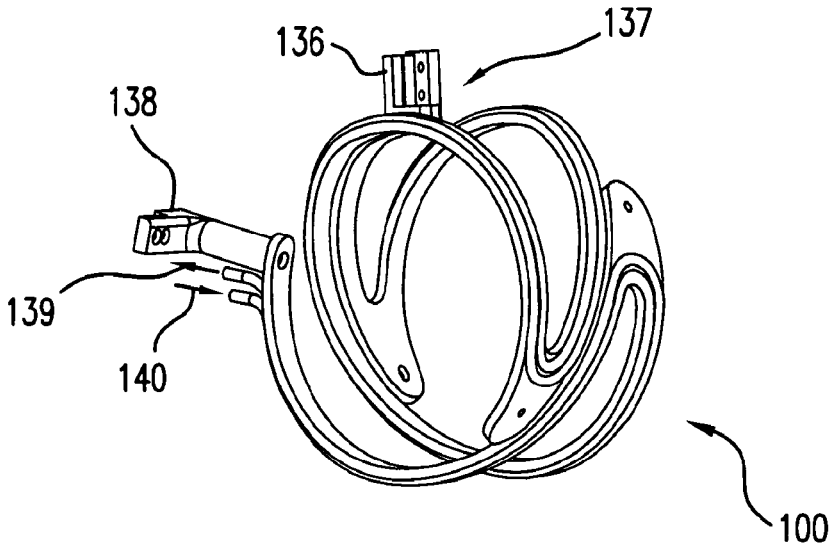
FIG. 18 depicts a re-entrant fluid loop allowing cooling of the RF coupler without requiring a cooling fluid connection in a region of high RF voltage.

A plasma source 100, according to an embodiment of the present invention, comprising an integrated thermal management solution comprising an RF feed 136 and a re-entrant fluid cooling loop at the RF ground point 138 is shown in FIG. 18. Said re-entrant cooling loop comprises cooling fluid 140 entering the loop, a fluid loop back 137, and reentrant 139. A thermal solution according to this embodiment allows an RF coupler 100 to operate for long-pulse or steady-state conditions at high power requirements for VASIMR or other applications. A plasma source according to an embodiment of the present invention comprises: a hollow fluid-filled RF coupler 100 that is in fluid communication with a heat exchanger and said fluid circulates and transfers waste heat to said heat exchanger. This embodiment integrates two windings of the conductor for enhanced RF coupling to the plasma with a fluid-loop cooling solution that can allow long-pulse or steady-state operation of the coupler.

An antenna such as those described above may also require additional thermal protection from other heat sources. The thermal protection must be compatible with the RF energy going into the plasma and to minimize RF losses in the thermal protection components. Although the antenna may be isolated from the ionized plasma by a magnetic field, heat is still radiated back to the antennas. Sometimes, in the Helicon section, a cold neutral atom gives an electron to a hot ion. Because the resulting hot neutral is not affected by the magnetic field, it can travel radially, deposit its energy on nearby structures, heat those structures, and thereby waste the energy that otherwise would have been used for propulsion. The ICRH antenna of the VASIMR, on the other hand, can heat plasma to many millions of degrees Kelvin, but generally, the plasma in this section is completely ionized so there are very few neutrals to donate electrons and there are very few hot neutrals escaping the magnetic field. A tube having reasonably transparent properties with respect the RF, is positioned coaxially between the plasma stream and the antenna to contain neutral gases and can carry some of the radiated heat away from the antennas. Another possible thermal protection means involves the use of a heat pipe. In this case the antennas are imbedded in a fluid filled tube wherein the fluid carries heat from the antennas. An antenna within a heat pipe must be embedded in an electrical insulator so that the signal is not grounded out. Thermal protection means for the antenna must be transparent to the RF energy that passes from the antenna to the target gas and plasma.

Figure 19:
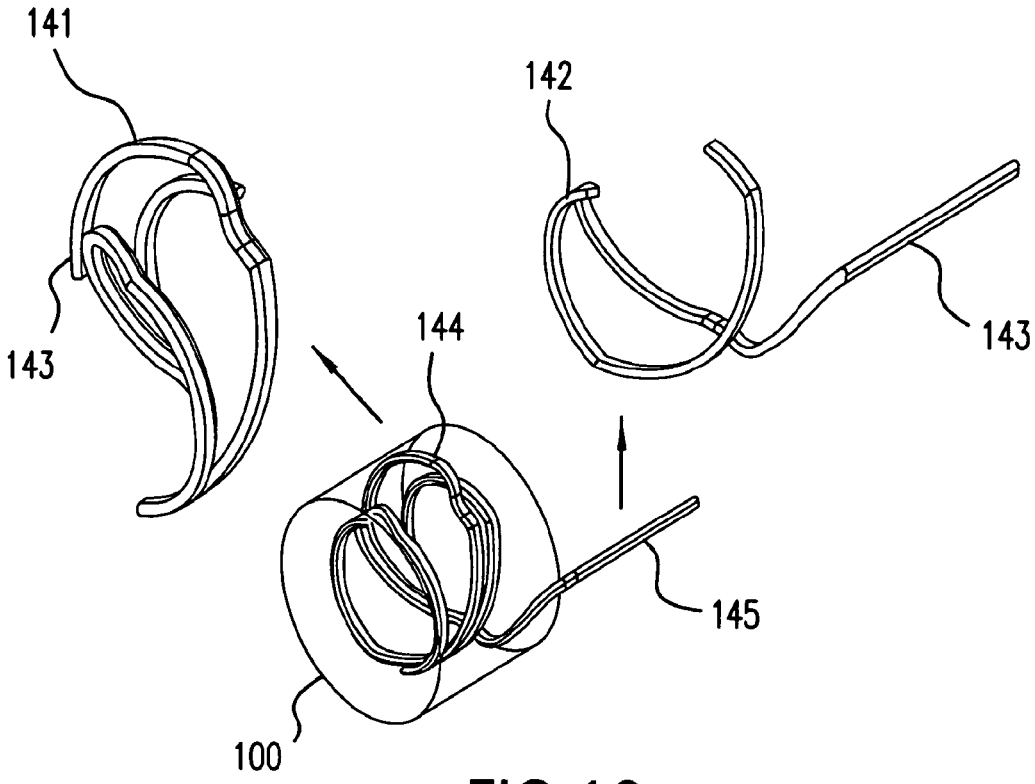
FIG. 19 depicts an embodiment of the present invention comprising an RF coupler wherein the electromagnetic coupler design required for efficient power coupling to the plasma comprises an integral heat-pipe for cooling the coupler winding.

An RF coupler according to an embodiment of the present invention is shown in FIG. 19 and comprises RF electrical connections (Ground End 144, and High Voltage End 145), a passive heat-pipe system (First Heat Pipe Coupler Strap 141, Second Heat Pipe Coupler Strap 142, and Condenser 143) that can transfer heat through both RF connections, wherein said heat-pipes transfer waste heat to a heat exchanger. Such a thermal solution does not require a high voltage connection across the cooling loops path and provides heat transfer from the RF coupler 100 back to supporting heat sinks or heat exchangers (not shown).

Figure 20A:
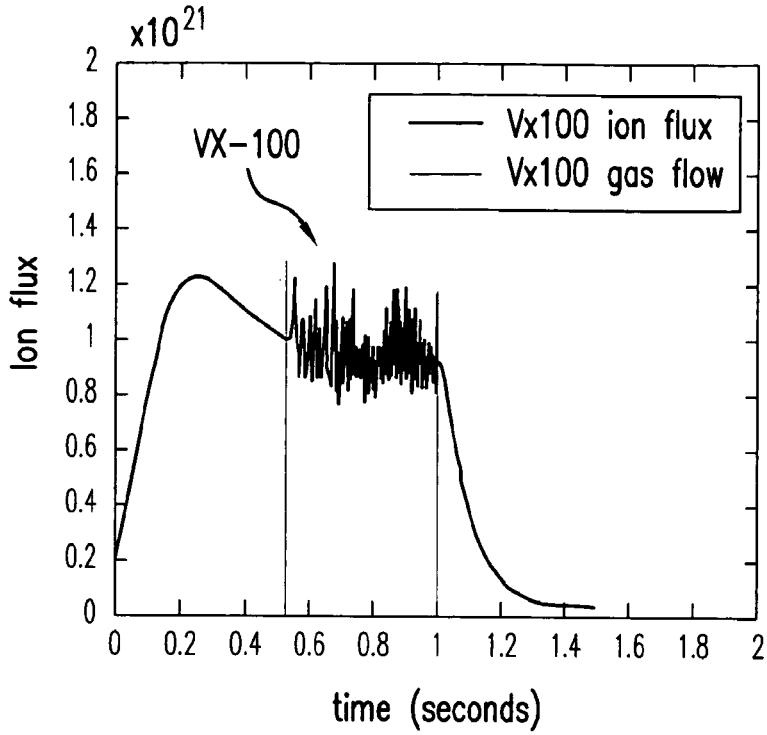
FIG. 20*a* depicts the plasma ion flux versus time in accordance with the VX-100 embodiment of the present invention.
Figure 20B:
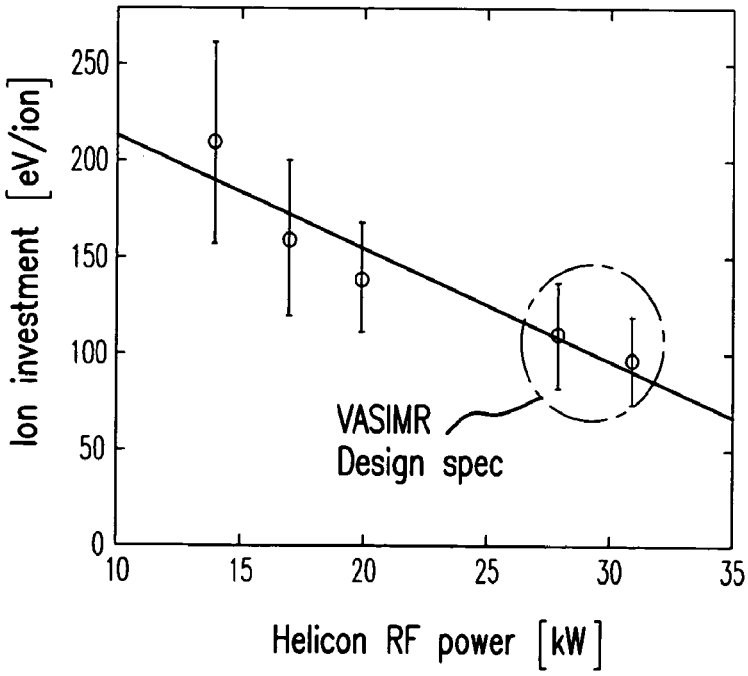
FIG. 20*b* depicts the energy investment required to extract an electron-ion pair in the plasma stream as a function of the RF power coupled to the first stage of the VX-100 embodiment of the present invention.

Experimental results from one embodiment of the present invention, known as VX-100, are given in FIGS. 20*a* and 20*b*. This embodiment used a first stage ionization source up to 30 kW of RF power, limited by the amplifier power available, and a low power second stage to test the effectiveness of ion heating of the plasma stream. A neutral feedstock of argon gas was ionized for these tests. In this embodiment of the invention, a second stage with high magnetic field strength, over 1 Tesla, was implemented for testing the heating efficiency of the second stage at low RF power.

The plasma flux of the VX-100 embodiment was measured using an array of 10 probes (not shown), positioned across the outgoing plasma stream, drawing ion saturation current. At maximum power, the ion flux was estimated to exceed $10^{21}$ ions/second, ionizing 100% of the injected neutral gas as shown in FIG. 20*a*. FIG. 20*b* presents the energy cost per extracted ion-electron pair in the stream for a range of RF power in the first stage. For this embodiment of the invention, the performance improves with higher power in the first stage. For this operation, a 70 GHz density interferometer could not reliably measure the plasma density in the stream at the outlet of the source because of a fundamental cut-off limitation in the diagnostic technique; however, cut-off for this interferometer frequency indicates a plasma density at the exit of the second stage of over $10^{19}$ $m^{-3}$.

Figure 21:
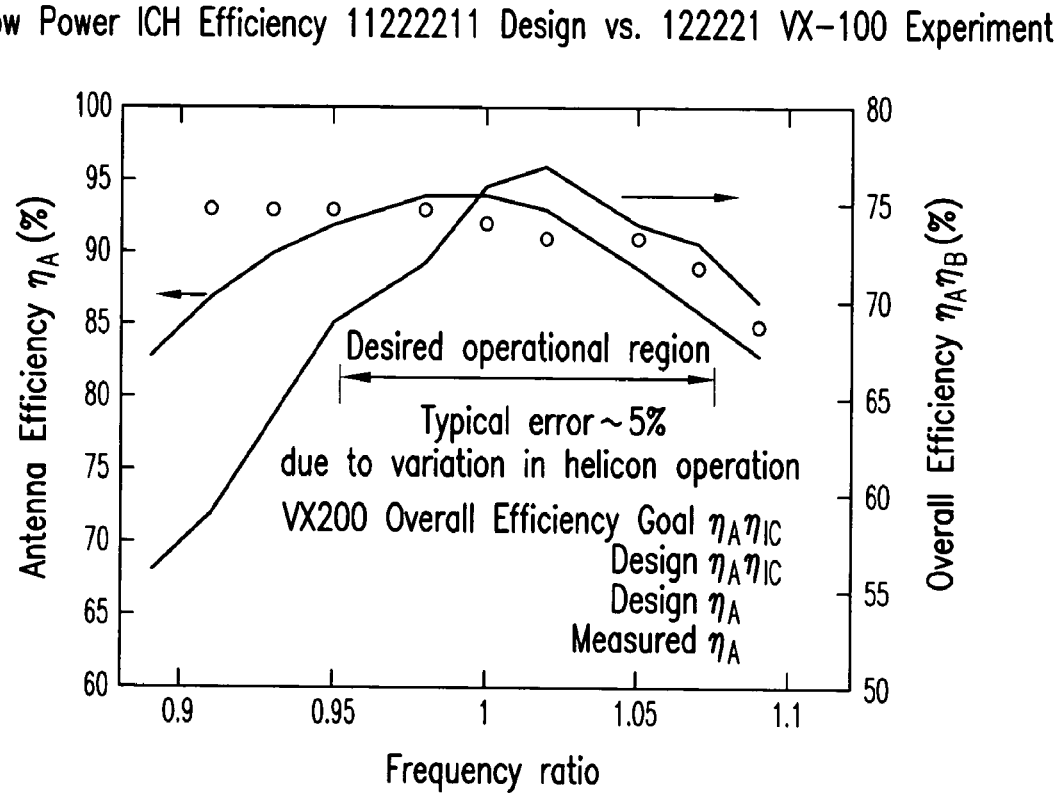
FIG. 21 depicts RF coupling efficiency results of tests performed on the second stage of the VX-100 embodiment of the present invention.

Efficient ICH coupling to the plasma stream was also demonstrated for argon ions in these experiments with the VX-100 embodiment of the present invention. The efficiency was measured using Q measurements of the second stage with and without plasma to isolate the plasma loading and circuit efficiencies. The results are contained in FIG. 21, where we plot the measured and calculated antenna coupling efficiency for a frequency scan. Also in FIG. 21, we present calculations of the ion energy boost efficiency, $\eta_{\vec{B}}$, by the second stage for this embodiment of the invention. This VX-100 embodiment demonstrates overall efficiencies for the second-stage system in excess of the 70% design goal useful for VASIMR engines. Calculations for the second stage of this embodiment indicate that the power can be preferentially directed into ions rather than electrons.

Here we present a concept for removing the waste heat that is deposited into the walls of the ionization chamber. A significant fraction of the RF power transmitted into the ionization chamber is deposited into the chamber walls either in the form of radiation or convection of the plasma. This heat must be removed in order to keep the material temperatures low enough to maintain structural integrity and to keep the loss tangent of the gas containment tube (normally a ceramic) low. Since the antenna 100 should be placed as close as possible to the ionization chamber, the thickness of the gas containment tube is practically limited to about 1 cm. The only material that might be able to conduct the heat axially along the tube for the length of the antenna is diamond. An embodiment of the present invention is a more practical solution—an ionization chamber in which the walls are actively cooled. As shown in FIG. 8, the fluid flows through a flow inlet 119 into a manifold 118 at the upstream end of the ionization chamber 115 to distribute the flow evenly in the annular region around the chamber. The annular region consists of two tubes 108, having dielectric properties that are compatible with the RF, oriented coaxially with a small gap (a few millimeters) between them. The thickness of the ceramic tubes 108 is governed by the strength of the material, the pressure of the fluid, and the heat load on the inner tube 108.

These, typically ceramic, tubes must be chosen based on having a low loss tangent at the operating temperature, thermal conductivity, and strength. The fluid then flows into a downstream manifold 117 where it exits the helicon section through the flow exit 116 to reject the heat.

This innovative combination of a high-power helicon antenna and thermal control system allows for plasma mass flow throughput and densities never before achievable in steady state.

Since the fluid must pass between the helicon antenna and the plasma, it must also have a low loss tangent at the operating temperature. To reduce the thickness of the tubes, the fluid must also have a low vapor pressure and viscosity at the operating temperature. We have found that silicon oils can meet these requirements, although other fluids may also be used, and some heat-pipe concepts may be possible.

Various antenna properties have been tested for use with the VASIMR. The optimal geometry for the helicon antenna, for example, appears to be a half-twist double helix with the gas stream running through the center. Additional plasma coupling can be obtained as needed by connecting electrically isolated antennas in series. Early ICRH antennas generally comprised a series of short cylindrical tubes or rings spaced a distance from one another along the axis of the gas stream, although helical antennas provide the optimum ICRH performance for many applications. The antennas need not be bulky, but they must be formed from a good conductor at the RF frequencies used. These antennas must be cooled for steady state operation because of the heat dissipated in them by RF currents flowing through them and other possible heat sources. Both fluid loop and heat-pipe cooling techniques are feasible depending on the application.

Figure 2:
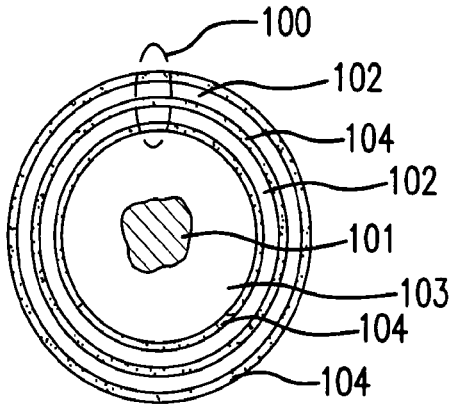
FIG. 2 depicts a cross section of a ring type antenna comprising alternating layers of a metal substrate and layers of a thermally conducting material, in accordance with an embodiment of the invention.

Referring to FIG. 2, a gas or plasma stream 101 and a vacuum 103 are again found inside the antenna 100. In accordance with an embodiment of the invention, a plurality of alternating metal 102 and thermally conducting material 104 layers form the antenna. Functionally, heat is conducted away from the metal layers 102 (which deliver the RF energy to the stream 101) through the thermally conducting material layers 104.

Figure 3:
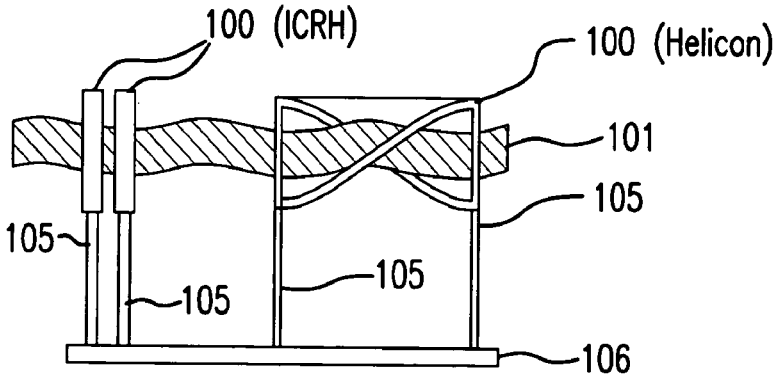
FIG. 3 depicts a frontal view of antennas connected to a remote heat exchanger, in accordance with an embodiment of the invention.

Referring to FIG. 3, in accordance with an embodiment of the invention, heat is conducted away from the metal layers 102 through the thermally conducting material layers 104 to the antenna supports 105. The heat is delivered through the antenna supports to a remote heat exchanger 106.

Figure 4:
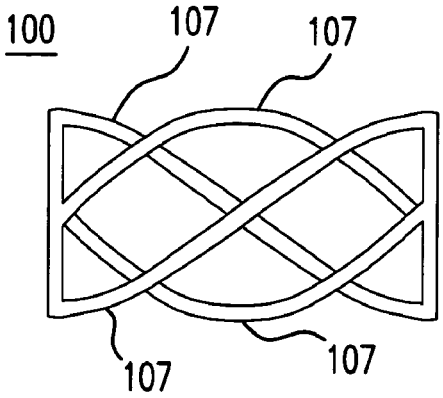
FIG. 4 depicts a frontal view of a four-strap, half-twist antenna geometry for either a helicon or an ICRH antenna, in accordance with an embodiment of the invention.

Referring to FIG. 4, one possible geometry for an antenna 100 in accordance with an embodiment of the invention is illustrated. Four straps 107 are depicted connecting two end rings 109 providing support. Each surface of a strap 107 or an end ring 109 may be covered with a thermally conducting layer. Using more straps results in a greater electrical load.

Figure 5:
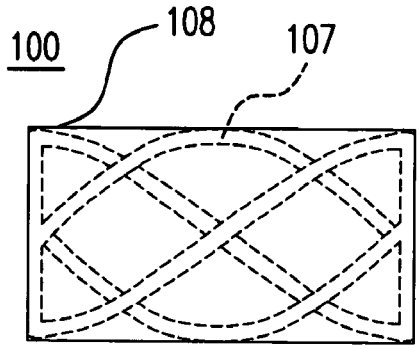
FIG. 5 depicts a frontal view of a four-strap, half-twist antenna entirely embedded in a solid cylindrical tube of a thermally conducting material, in accordance with an embodiment of the invention.

Referring to FIG. 5, another possible geometry for an antenna 100 in accordance with an embodiment of the invention is illustrated. Four straps 107 are embedded in a hollow cylindrical surface 108 made of diamond, quartz, or another thermally conducting insulators. The geometry of the straps is similar to the geometry shown in FIG. 4. The antenna 100 is generally a tube shape allowing gas or plasma to flow through its center. Having a tube where thermally conducting material fills the gaps between the straps, rather than just a thin coating on the straps, means that there is more thermally conducting material to handle a greater heat load. Heat can then be conducted away from the antenna arms more quickly, keeping the antenna cooler. One method of manufacture would be to etch a dielectric tube and sputter copper onto it to create a single layer. Another method would be to form the metal substrate of the antenna and use the chemical vapor deposition process to build up a layer of diamond on the antenna. It may be possible to make multiple tubes of diameters that allow them to fit nested, one within the other, and electroplate them to join them together to create a single multilayer tube.

Figure 6:
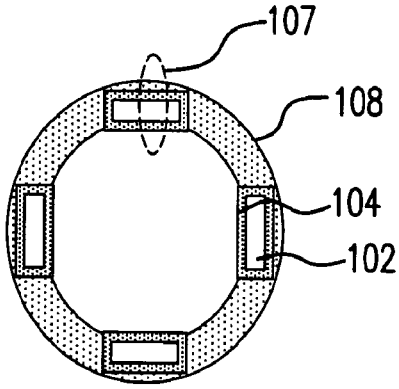
FIG. 6 depicts a cross section view of a four-strap, half-twist antenna geometry where all four surfaces of each rectangular-cross-section-metal strap are covered with a thermally conducting layer, in accordance with an embodiment of the invention.

Referring to FIG. 6, a cross section of an antenna in accordance with an embodiment of the invention is depicted where four straps 107 are each composed of a metal layer 102, and a thermally conducting layer 104, embedded in a thermally conducting tube 108. FIG. 6 depicts straps of a rectangular cross section where all four sides are covered with a thermally conducting layer 104. Other embodiments of the invention may contain straps 107 only covered with a thermally conducting layer 104 on selected surfaces. In accordance with an embodiment of the invention, the thermally conducting layer 104 and the thermally conducting tube 108 may be of the same or of different materials. For example, in one embodiment, the thermally conducting layer 104 is made of CVD diamond and the tube 108 is made of quartz. Both the thermally conducting layer 104 and the thermally conducting tube 108 carry heat away from the antenna 102 to a heat exchanger (not shown).

Figure 9:
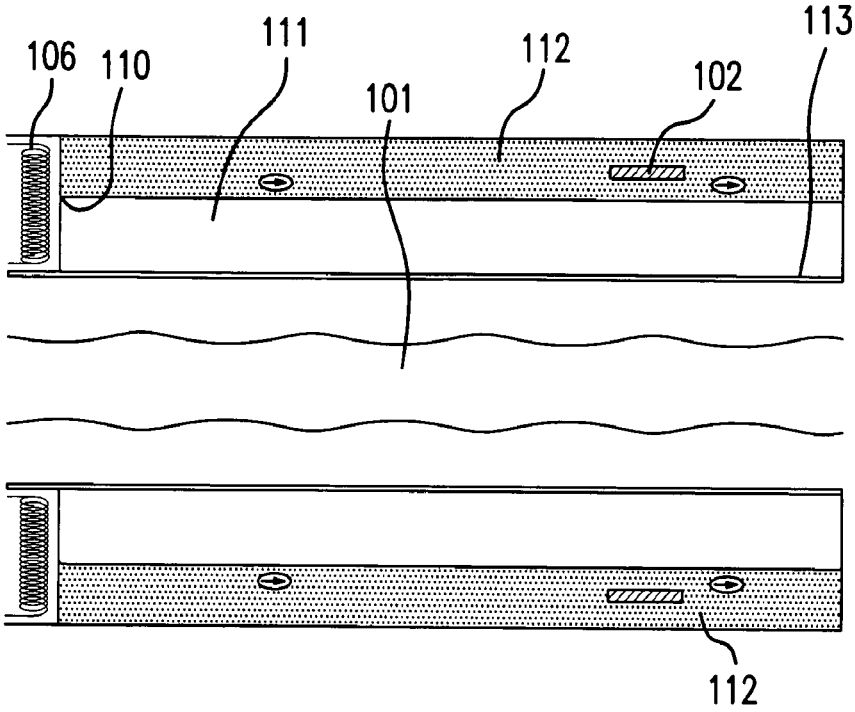
FIG. 9 depicts a longitudinal section view of the heat pipe surrounding the ionization chamber, in accordance with an embodiment of the invention.

FIG. 9 depicts a longitudinal section view of the heat pipe surrounding the plasma stream. Plasma 101 approaches the heat pipe at the condenser end near a heat exchanger 106. The plasma 101 flows in the vicinity of the heat pipe's interior wall 113 until it passes the antenna 102. The antenna 102 is embedded in the wick 112. The antenna must be insulated so that the signal won't be grounded out. Optionally, the antenna may be coated with a layer of CVD diamond or other dielectric for additional capacity to transfer heat away by conduction through the dielectric coating. Downstream of the ICRH antenna 102 the plasma 101 reaches its highest temperatures and radiates heat to the evaporator end of the heat pipe. Heat from the plasma evaporates liquid working fluid in the wick 112 and draws it into the vacuum tight envelope 111 as a vapor.

The working fluid is drawn to the relatively low pressure at the condenser end of the heat pipe where it condenses again to a liquid 110 and enters the wick 112. The arrows indicate the flow of the working fluid within the heat pipe. The working fluid should be transparent to the RF energy transmitted through the antenna, so ammonia and nitrogen are good choices.

Figure 10:
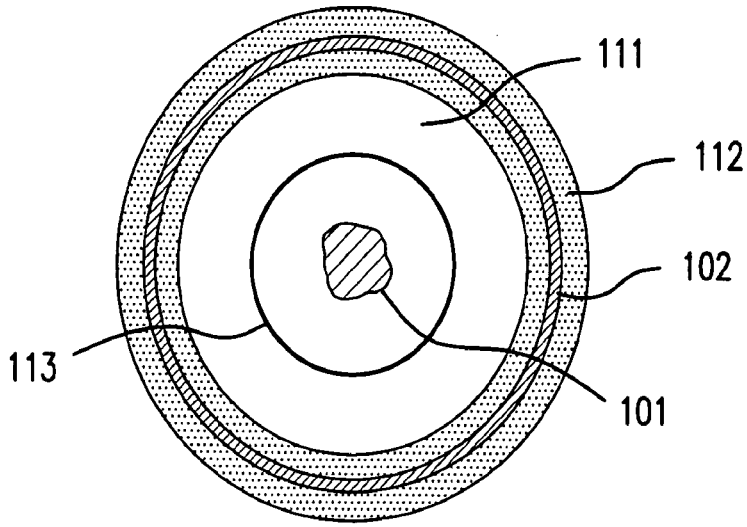
FIG. 10 depicts an axial section view of the heat pipe surrounding the ionization chamber, in accordance with an embodiment of the invention.

FIG. 10 depicts an axial section view of the ICRH antenna 102 embedded in the wick 112. The antenna shown in FIG. 10 is a simple ring type antenna, however alternate geometries may be used. It may also be possible to cool the helicon antenna in the same or similar heat pipe.

Figure 11:
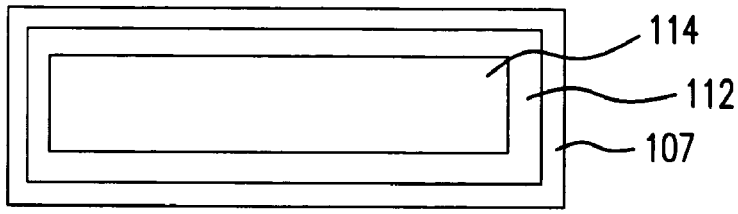
FIG. 11 depicts an axial section view of an antenna arm heat pipe, in accordance with an embodiment of the invention.
Figure 12:
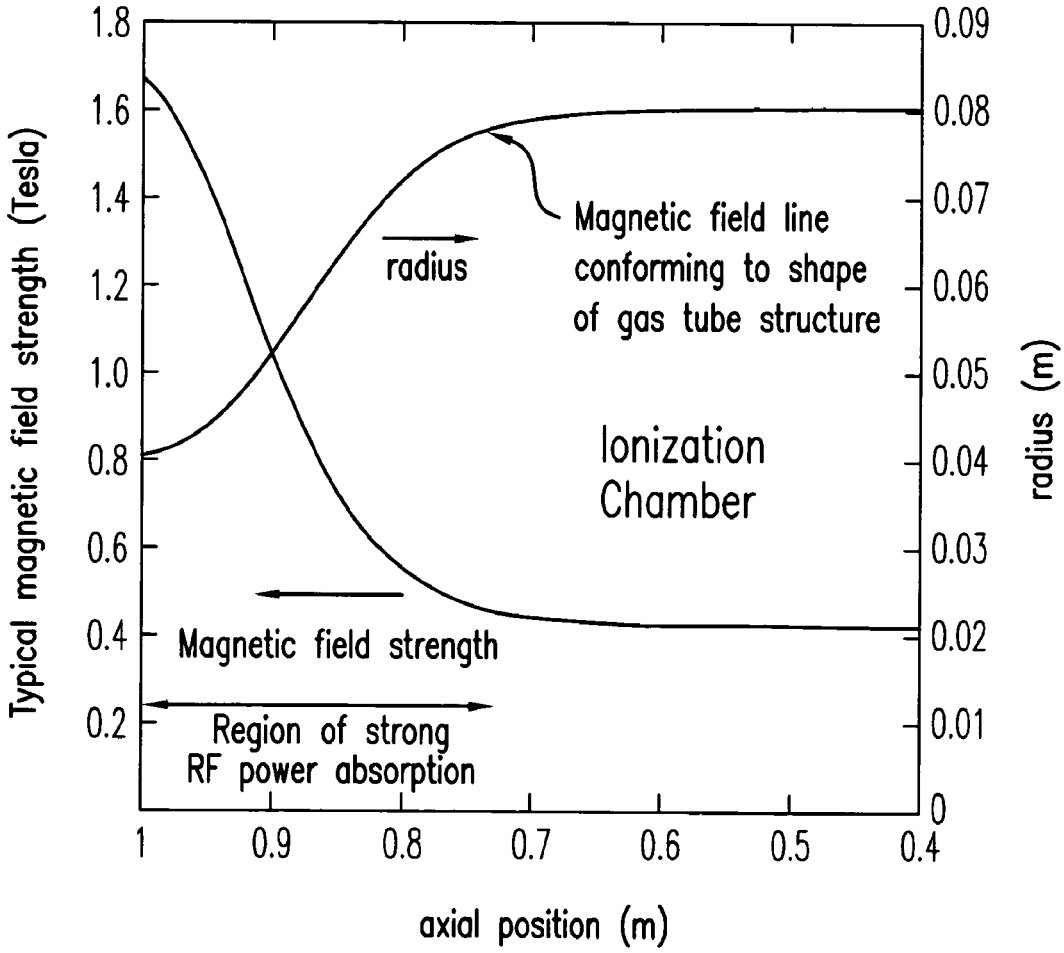
FIG. 12 depicts the magnetic field line alignment and magnetic field strength used to produce highly-ionized plasma downstream in an embodiment of the invention.

In another embodiment of the invention, the antenna comprises a heat pipe for carrying heat away to a heat exchanger. In this case, the antenna has a hollow cross section and comprises a fluid filled tube having a wick inside and the working fluid carries heat from the antennas to a heat exchanger. Heat from the plasma evaporates liquid working fluid in the wick and draws it into the vacuum tight hollow interior of the tube as a vapor. The vapor working fluid is drawn to the relatively low pressure at the condenser end of the heat pipe where it condenses again to a liquid and enters the wick. FIG. 11 depicts an axial section view of an antenna arm 107 (such as from a helicon or ICRH antenna) that can function as a heat pipe wherein said antenna arm has a hollow interior 114 containing therein a wick 112 and a working fluid to carry heat axially through said antenna arm 107 to a heat exchanger. Waste heat is transferred through antenna arm 107 to liquid working fluid in said wick 112 causing the working fluid to evaporate and flow axially through the hollow interior 114 of the antenna arm 107 to a heat exchanger where said working fluid condenses. Condensed working fluid then flows axially in the opposite direction by capillary action through said wick 112, completing the cycle. This embodiment is practical to implement because propagation only occurs on the surface of the antenna and is unhindered by interior components so the wick and working fluid need not be RF compatible. Many antenna geometries may be used.

It should be appreciated that although embodiments of the invention have often been described in the context of a VASIMR engine, the present invention has much broader potential application, and could be useful in any circumstance where efficient production of plasma is desirable.

In the foregoing specification, embodiments of the invention have been described with reference to numerous specific details that may vary from implementation to implementation. Thus, the sole and exclusive indicator of what is the invention, and is intended by the applicant to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A plasma source comprising an RF coupling system, magnets or coils that generate magnetic fields, a gas injection system, and a vacuum tight, an RF transparent gas containment tube, wherein said RF coupling system comprises an RF coupler and said plasma source further comprises a choke point wherein the ratio of the field strength at said choke point to the field strength at said RF coupler is greater than two.

2. A plasma source according to claim 1 wherein said RF coupler is a fluid cooled RF coupler.

3. A plasma source according to claim 1 further comprising an Ion Cyclotron Radio Heating (ICRH) antenna for accelerating ions within a plasma stream.

4. A plasma source according to claim 1 wherein the ratio of the field strength at said choke point to the field strength at said RF coupler is greater than about four.

5. A plasma source according to claim 1 further comprising or a booster stage; and wherein said magnetic fields are formed by magnets comprising four sub assemblies: (1) a first stage magnet, (2) a choke coil, (3) an ICRH magnet or booster magnet, and (4) a nozzle magnet.

6. A plasma source according to claim 1 wherein said plasma source further comprises a helicon antenna and an ionization chamber and wherein magnetic field strength at the helicon antenna is matched to the size of the ionization chamber.

7. A plasma source according to claim 6 wherein said ionization chamber is modular and interchangeable for an ionization chamber sized for a different gas and wherein a magnetic field geometry of the magnetic field generated by said helicon antenna being adjusted for said ionization chamber.

8. A plasma source according to claim 1 further comprising a solid choke made of ceramic.

9. A plasma source according to claim 1 further comprising a solid choke made of metal.

10. A plasma source according to claim 1 further comprising means for force feeding propellant directly downstream.

11. A plasma source according to claim 1 wherein said RF coupling system further comprises a strap wherein said strap comprises a thermally conducting layer.

12. A plasma source according to claim 1 wherein said RF coupling system further comprises a strap wherein said strap is embedded in a thermally conductive hollow cylindrical surface.

13. A plasma source according to claim 12 wherein said hollow cylindrical surface comprises diamond.

14. A plasma source according to claim 12 wherein said hollow cylindrical surface comprises quartz.

15. A plasma source according to claim 14 wherein a surface of said strap has a diamond coating.

16. A plasma source according to claim 1 further comprising a ceramic heat sink and wherein said RF coupling system further comprises a silver antenna in thermal communication with said ceramic heat sink.

17. A plasma source according to claim 1 wherein said RF coupler has a full twist double helix geometry.

18. A plasma source comprising an RF coupling system, magnets or coils that generate magnetic fields, a gas injection system, and a vacuum tight, RF transparent gas containment tube wherein said plasma source comprises a helicon antenna and an ionization chamber and wherein magnetic field strength at the helicon antenna is matched to the size of the ionization chamber, further comprising a fluid cooling circuit comprising said ionization chamber, an annular tube positioned around said ionization chamber, a flow inlet in fluid communication with a space between said ionization chamber and said annular tube, a heat exchanger in fluid communication with the space between said ionization chamber and said annular tube, an RF compatible cooling fluid that flows from said flow inlet, axially through the space between said ionization chamber and said annular tube to said heat exchanger.

19. A plasma source according to claim 18, wherein said cooling fluid is a suitable heat pipe working fluid, further comprising a heat pipe wick mounted in the space between said ionization chamber and said annular tube to form a heat pipe.

20. A plasma source comprising an RF coupling system further comprising an RF coupler, magnets or coils that generate magnetic fields, a gas injection system, and a vacuum tight, RF transparent gas containment tube wherein said RF coupling system comprises:

a. a hollow interior that is vacuum tight b. a fluid that can transfer heat wherein said fluid circulates through said hollow interior and transfers waste heat to a heat exchanger.

21. The plasma source of claim 20 wherein said coupler comprises two windings of a conductor.

* * * * *

UNITED STATES PATENT AND TRADEMARK OFFICE

CERTIFICATE OF CORRECTION

PATENT NO. : 8,593,064 B2
APPLICATION NO. : 12/449612
DATED : November 26, 2013
INVENTOR(S) : Franklin Chang Diaz et al.

It is certified that error appears in the above-identified patent and that said Letters Patent is hereby corrected as shown below:

Title Page:

Item 75 the list of inventors should read: Franklin Chang Diaz, Seabrook, TX (US); Jared P. Squire, Houston, TX (US); Tim W. Glover, Houston, TX (US); Leonard D. Cassady, Houston, TX (US); Mark D. Carter, Houston, TX (US); Greg E. McCaskill, Houston, TX (US).

Signed and Sealed this
Eighteenth Day of February, 2014

Michelle K. Lee

Michelle K. Lee
*Deputy Director of the United States Patent and Trademark Office*